United States Patent [19]

Terry et al.

[11] Patent Number: 4,462,485

[45] Date of Patent: Jul. 31, 1984

[54] LADDERS FOR TRANSOMS OF BOATS

[75] Inventors: John L. Terry; Robert G. Ritten, both of Ft. Pierce, Fla.

[73] Assignee: Step-On Inc., Ft. Pierce, Fla.

[21] Appl. No.: 458,527

[22] Filed: Jan. 17, 1983

[51] Int. Cl.[3] ..... B63B 29/20

[52] U.S. Cl. ..... 182/84; 182/91; 114/363; 280/166

[58] Field of Search ..... 182/91, 86, 33, 33.6, 182/83, 84, 97; 114/363; 280/166

[56] References Cited

U.S. PATENT DOCUMENTS

| | | | |
|---|---|---|---|
| 493,373 | 3/1893 | Alexander | 182/91 |
| 2,197,266 | 4/1940 | Fredell | 182/91 |
| 2,246,985 | 6/1941 | Pellegrini | 182/97 |
| 3,195,680 | 7/1965 | Thornburg | 182/92 |
| 3,627,350 | 12/1971 | Cross | 182/91 |
| 3,774,720 | 11/1973 | Hovey | 182/91 |

*Primary Examiner*—R. P. Machado
*Attorney, Agent, or Firm*—Carroll F. Palmer

[57] ABSTRACT

Improved ladders for attachment to the transoms of boats comprise a platform section that includes horizontal planking and depending tubular frame members and a ladder step section pivoted on the tubular frame members below the planking for movement betwen a retracted position wherein the step is raised above the planking inboard of the rear end of the platform and an extended position wherein the step is lowered below and aft of the planking. The step is structured so as to limit the extent it will lower below the planking. The new ladder design enables the platform to be free of any elements, such as brackets, etc., and for the step to be aft of the boat's propeller, rudder, etc. When the step is in the extended position to eliminate possible snagging of gear worn by the ladder user or other interference to the user of the free use of the full area of the platform or of the ladder.

10 Claims, 15 Drawing Figures

LADDERS FOR TRANSOMS OF BOATS

BACKGROUND OF THE INVENTION

1. Field of the Invention

The invention relates broadly to ladders to be attached to the transoms of boats in assist persons using the boats to board the boat from a position immersed in the water beside the boat or to safely debark from the boat even when loaded with scuba equipment or other gear. More particularly, it concerns boat ladders that provide a working platform attached to the stem of a boat and foldable step sections that provide easy and safe access from or to the platform into or out of the water surrounding the boat.

2. Description of the Prior Art

A variety of platform and ladder devices have been developed and marketed for attachment to the transoms of boats to assist in boarding or debarking the boats or to help in moving or working about the stern of the boats. These prior devices can be divided broadly into three classes, i.e., (1) those that are strictly ladders and provide no real platform function, (2) those that are strictly platforms and (3) those that provide combination ladder and platform functions. The present invention relates the devices of the third type.

In the devices of the third type in the prior art there is typically a platform that attaches to the boat transom plus some form of depending step arrangement that assist the user of the device to lower or raise his body upon one or more steps positioned at a level below the platform. In some forms of such devices, the depending step or steps are fixed immoveably to the platform while in others the step or steps are hinged or otherwise arranged to move between a lowered, use position and a raised, storage position. The present invention concerns boat ladder devices of the moveable step type.

The prior art devices of the type to which the present invention relates as stated above have a number of undesirable aspects. Firstly, many of them are fixed to the boat transom by braces that extend downward from the boat transom and outward at both sides to the outside end of the platform section. Hence, these braces create a fence or obstruction at the sides of the platform that seriously limits the effective, useable area of the platform. For example, a person positioned on such a platform wearing scuba gear can not swing the gear over the side of the platform, but must move it fore and aft within the confines of the side braces.

Secondly, many such type prior art devices use brackets to mount the step section that are fixed upon the uppr surface of the platform. Such upwardly extending items can snag clothing or gear carried by the user of the device as the user is seated on the platform or moves about it.

Thirdly, many such type prior art devices have the moveable step section mounted to the platform section in a manner that the step section is not sturdily fixed when in the lowered, use position with the result that the user is bothered by having to lift his body on an unsteady step. This is particularly bothersome when the user is carrying heavy gear, e.g., scuba gear, since the added weight serves to aggravate the unstable conditions.

OBJECTS

A principal object of the present invention is the provision of new improvements in boat ladders of the combination platform-moveable step type.

Further objects include the provision of:

1. New forms of ladders for attachment to the transoms of boats.
2. Boat ladders with platform portions that provide the user with unobstructed use of the full area of the platform.
3. Such ladders in which the platform is free of upwardly extending brackets or other items that may snag clothing or other gear worn by the user of the device.
4. Such ladders having moveable step sections in which the step section when in the lowered, use position is fixed against swinging or other movement so a user is presented with steady step or steps upon which to lift his body and any gear which he carries.
5. New boat ladder-platform combinations of having improved safety and function features.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished according to the present invention by the provision of new ladder devices for attachment to the transoms of boats that comprise a platform section for attachment to the transom of a boat including horizontal planking and depending tubular frame members, a ladder section having at least one step pivoted for movement between a retracted position wherein the step is raised above the planking inboard of the rear end of the platform section and an extended position wherein the step is lowered below the planking outboard of the rear end of the platform section, the pivoting of the ladder section being upon the tubular frame below the plane of the planking whereby the platform section is free of any elements extending above the planking when the ladder section is in the extended position.

In the preferred embodiments of the invention, means is provided to limit the extent the ladder section lowers below the planking when moved into the extended position. Advantageously, the tubular frame members are quadrangular in shape comprising a top section, a bottom section, an inboard side section and a outboard side section and the ladder section is pivoted on the outboard side sections of the quadrangular tubular members adjacent the corner junction of their outboard side section with their bottom section.

BRIEF DESCRIPTION OF THE DRAWINGS

A more complete understanding of the invention may be had by reference to the accompanying drawings in which.

DESCRIPTION OF THE PREFERRED EMBODIMENTS

Figure 1:
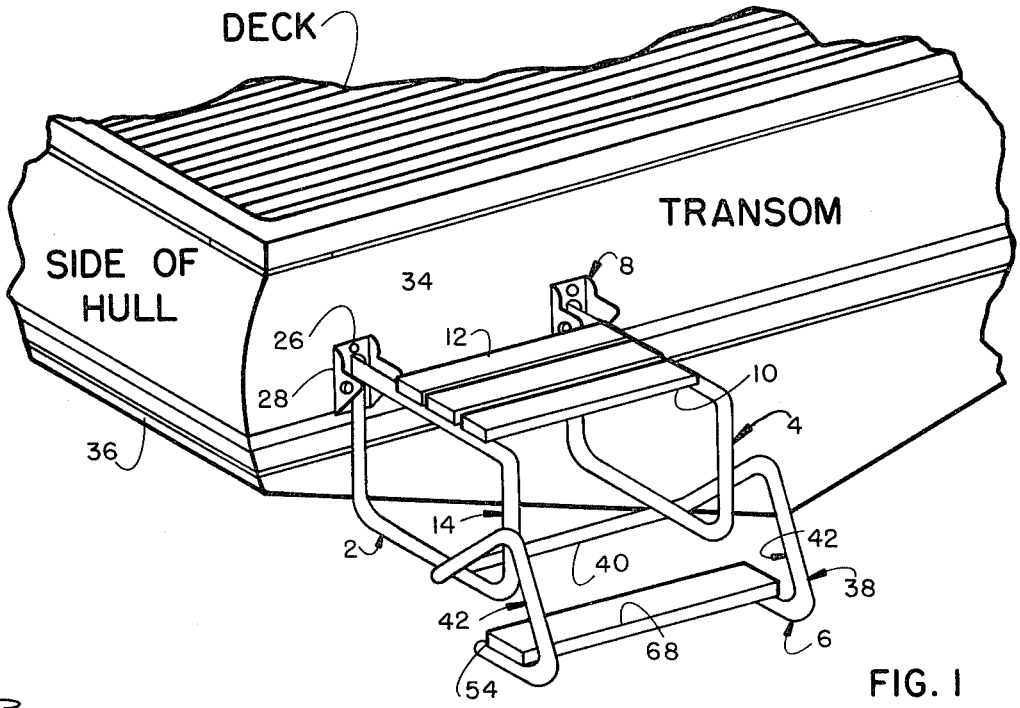
FIG. 1 is a fragmentary, isometric view of a boat equipped with a first embodiment of boat ladders in accordance with the invention.

Referring is detail to the drawings in which like parts are identified by similar numbers, the ladder 2 comprises a platform section 4, ladder section 6 and mounting brackets 8.

The platform section 4 includes horizontal planking 10 in the form of wood strips 12 and depending tubular frame members 14. The members 14 are quadrangular in shape comprising top section 16, bottom section 18, inboard side section 20 and outboard side section 22. The wood strips 12 are fastened to the top section 16 by screws 24 or other suitable fasteners.

The brackets 8 may be of a variety of forms. Advantageously, they comprise a base 26 with a pair of spaced apart lugs 28 extending from one side thereof and holes 30 through which bolts 32 may extend to mount the ladder 2 on the transom 34 of the boat 36.

The ladder section 6 comprises a third tubular member 38 having a central section 40, and two parallel end sections 42 integral with the central section 40. The end sections 42 are disposed in parallel planes substantially perpendicular to the central section 40. The end sections 42 are substantially identical and comprise a first short leg 44 joined at one end 46 to the central section 40, a long leg 48 joined at one end 50 to the other end 52 of the short leg 44 and a second short leg 54 joined at one end 56 to the other end 58 of the long leg 48.

All the legs 44, 48 and 54 of the end sections 42 lay in one plane with the long leg 48 being approximately perpendicular to the short leg 44 and with the second short leg 54 extending from the long leg 48 at an acute angle toward the short leg 44.

The quadrangular members 14 are positioned in substantially parallel planes and are spaced apart a suitable distance so that when the planking 10 spans the space between them, a relatively flat user supporting and working space is provided. While the figures show planking 10 made of separate strips 12 of wood, etc., the planking 10 may be formed of a single sheet (not shown) of wood, metal or the like.

The central section 40 of the third tubular member 38 is of such length that the end sections 38 are spaced apart approximately the distance between the outboard sides of the members 14 so that the member 38 can span the outside of the platform section 4. The ladder section 6 is hinged to the outboard side sections 22 of the platform section 4 adjacent the corner 60. The hinge unit can be a clevis pin 62, washer 64 and cotter 66 or any other suitable hinge arrangement.

Figure 2:
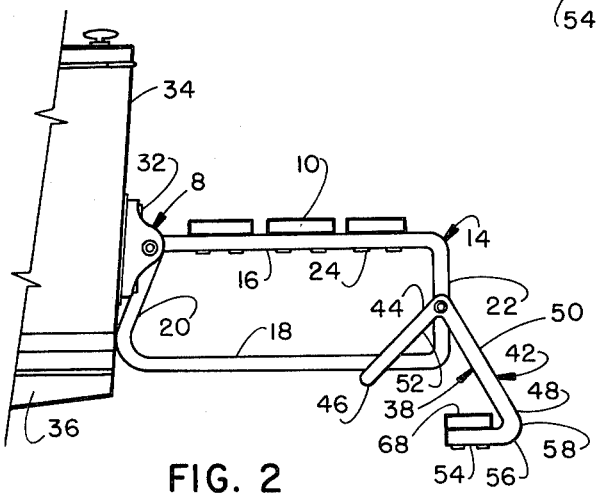
FIG. 2 is a lateral, fragmentary view of the boat ladder of FIG. 1 with the step section of the ladder in its extended position.
Figure 5:
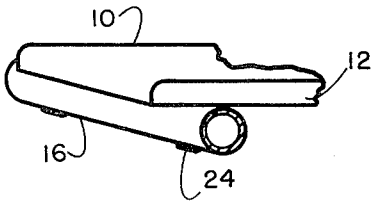
FIG. 5 is an enlarged, fragmentary, sectional view of a portion of the platform section of the ladder of FIG. 1.

The extended position for the ladder section 6 is shown in FIG. 2. As seen, the step 68 that spans the distance between the second short legs 54 in this position of the section 6 is located below the planking 12 outboard of the rear end of the platform section 4. The central section 40 of section 6 bears against the lower side of the bottom section 18 to serve as means to limit the extent the step lowers below the planking. This arrangement holds the step 68 in a firm, steady condition so that a user of the ladder 2 can confidently lift his body and gear weight out of the water surrounding the boat 36 and move onto the planking 12 without difficulty or hindrance to his body or gear that he may be carrying.

Figure 3:
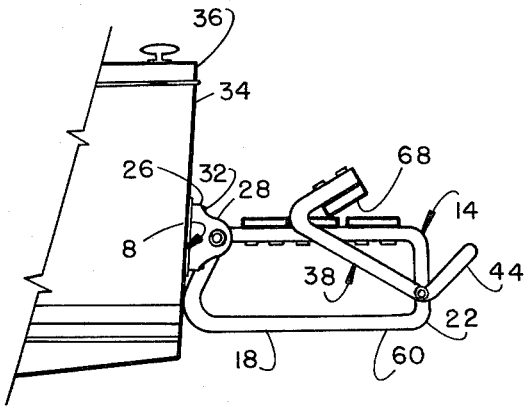
FIG. 3 is a lateral, fragmentary view similar to FIG. 2 showing the step section of the ladder in its retracted position.

The retracted position for the ladder section 6 is shown in FIG. 3. As seen, the step 68 is raised above the planking 12 and is positioned inboard of the rear end of the platform section 4. When the ladder 2 is properly positioned on the boat transom 34, the bottom section 18 will be above the water line so all of the ladder section 6 will be completely out of the water offering no resistance to movement of the boat 36 through the water.

Figure 4:
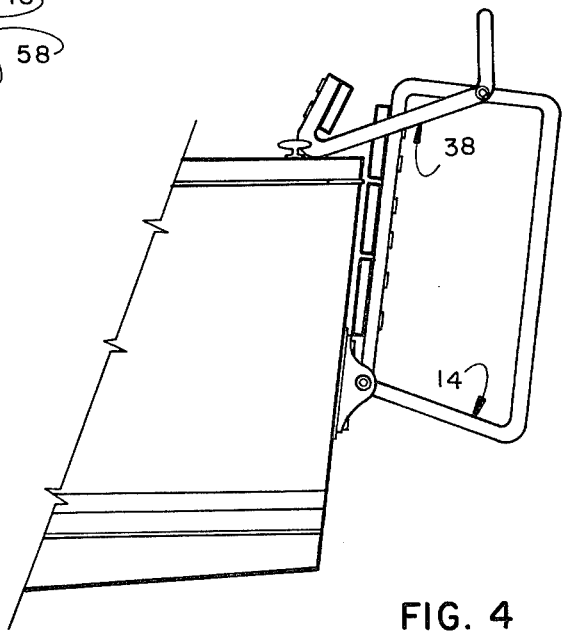
FIG. 4 is a lateral, fragmentary view similar to FIG. 2 showing the ladder in its folded up position.

The normal position for the ladder section 6 when the boat 36 is underway will be as seen in FIG. 3. However, for storage of the boat 36 or when maneuvering in close quarters, the ladder may be moved into the folded position shown in FIG. 4.

Figure 9:
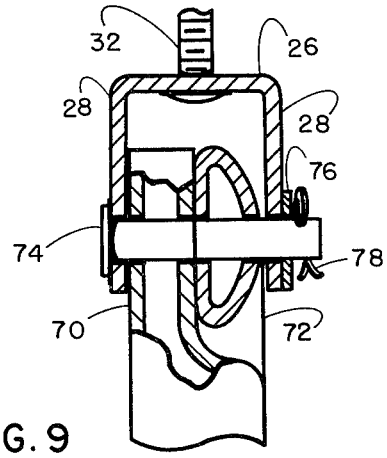
FIG. 9 is a fragmentary, sectional view taken on the line 9—9 of FIG. 8.
Figure 10:
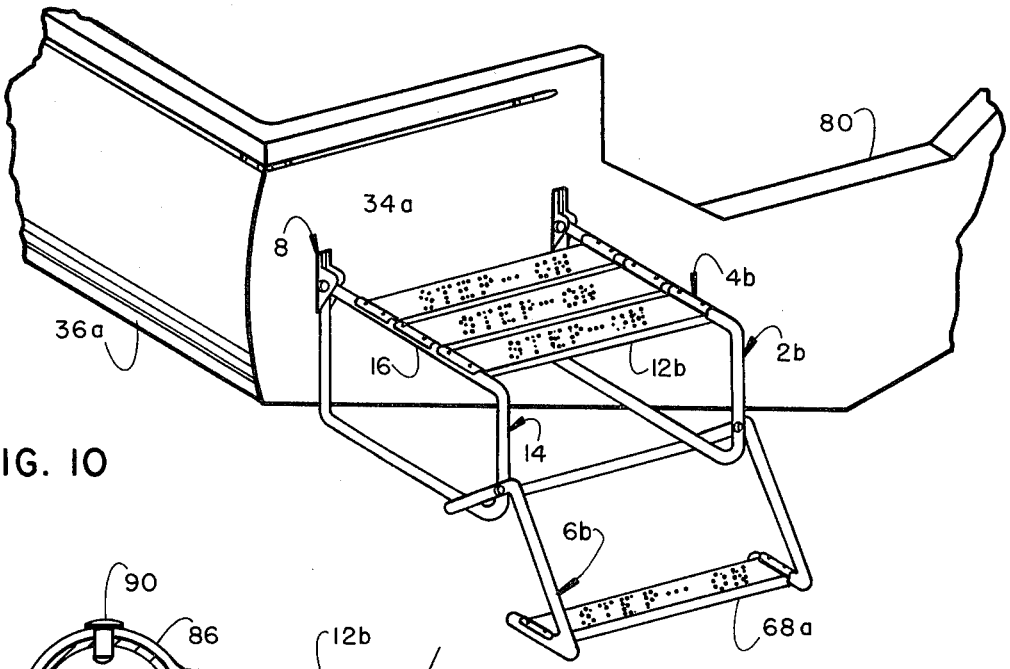
FIG. 10 is a fragmentary, isometric view of a boat equipped with a third embodiment of boat ladders in accordance with the invention.

The frame members 14 can be structured in several ways. For example, they can be in the form of a continuous closed tube formed by welding a length of tubing bent into the desired shape. However, a preferred structure is shown in FIGS. 9 and 10 where, instead of being welded together, the ends 70 and 72 of the tubular member 14 are partially flattened and are overlapped to create a corner by which the members 14 are hinged to the brackets 8 via clevis pins 74, washers 76 and cotters 78. Of course, nuts and bolts or any other suitable type fasteners may be used as the hinge pins.

Figure 6:
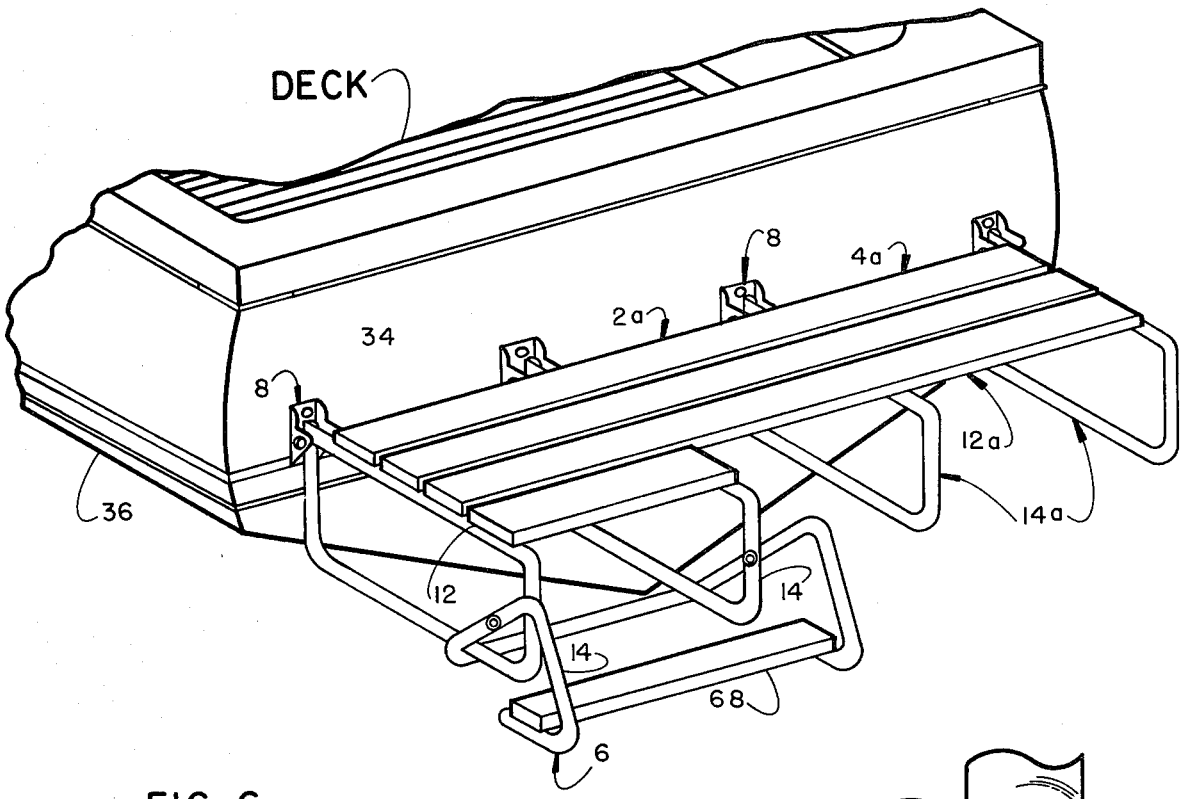
FIG. 6 is a fragmentary, isometric view of a boat equipped with a second embodiment of boat ladders in accordance with the invention.
Figure 7:
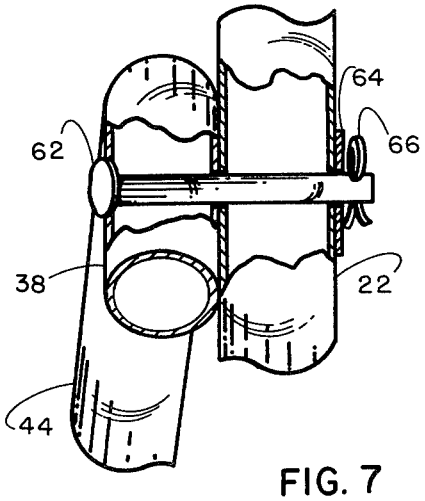
FIG. 7 is an enlarged, fragmentary, sectional view of a hinge arrangement between a platform section and step section of ladders of the invention.
Figure 8:
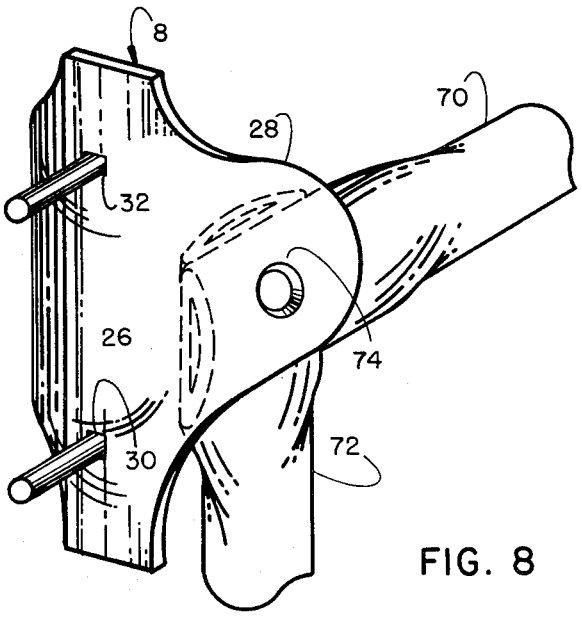
FIG. 8 is an enlarged, fragmentary, lateral view of a hinge arrangement between a platform section and a boat mounted bracket in ladders of the invention.

The embodiment of the invention shown in FIG. 6 comprises a platform section 4*a* that extends appreciably across the transom 34 of the boat 36. Support for the longer planking 12*a* is provided by the additional tubular frame members 14*a* fastened to the boat transom 34 via additional brackets 8. For manufacturing and inventory purposes, the members 14*a* can be like the members 14, i.e., quadrangular in shape, but, alternatively, since they need not support a ladder section, they can be of triangular shape (not shown).

The ladder device 2*a* may be moved into retracted and folded positions as shown and explained relative to the embodiment of FIG. 1.

Figure 11:
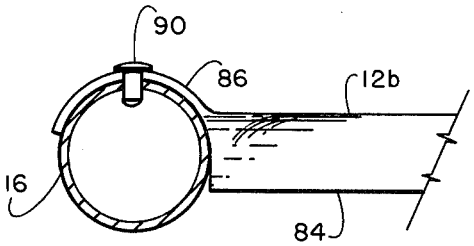
FIG. 11 is a fragmentary, sectional view taken on the line 11—11 of FIG. 10.
Figure 12:
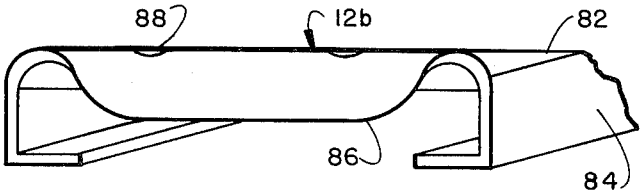
FIG. 12 is a fragmentary, sectional view of a portion of metal planking used in construction of ladders in accordance with the invention.
Figure 13:
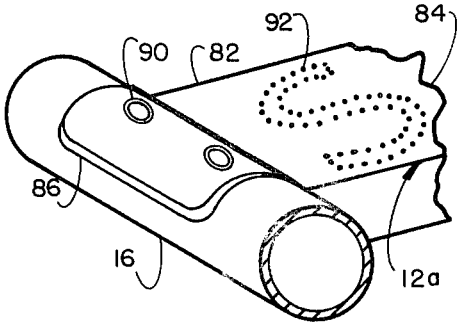
FIG. 13 is a fragmentary, isometric view of a portion of a platform section of the ladder of FIG. 10.

The boats 36 are of an inboard or O/I type while the boat 36*a* of FIG. 10 is of the outboard type in which the transom 34*a* includes the conventional cut-out portion 80 for mounting of an outboard motor (not shown). The boat 36*a* is shown equipped with a third embodiment of the invention. Thus, the ladder 2*b* is essentially like the ladders 2 except that the platform section 4*b* and the ladder section 6*b* are provided with metal planking 12*b* instead of the wood planking 12. The metal planking can be formed and mounted to the members 14 and 38 in a variety of ways, but a preferred arrangement is shown in FIGS. 11–13.

The metal planking 12*b* can be formed from sheet metal pressed or otherwise shaped to have a support web 82, depending L-shaped portions 84 and concave end portions 86 having fastener holes 88. The planks 12*b* are fixed to the tube sections 16 of members 14 by blind rivets 90 or equivalent fasteners. The support webs 82 of planks 12*b* may have embossing 92 or similar roughened portions to provide a non-skid surface.

Figure 14:
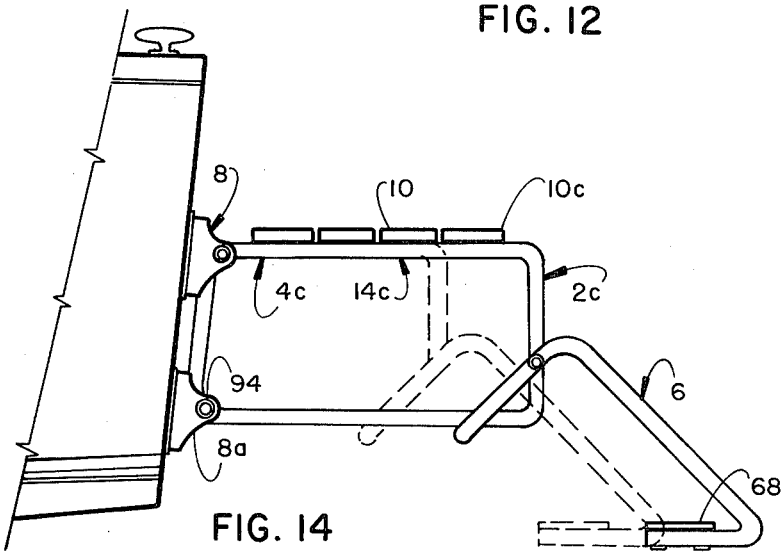
FIG. 14 is a fragmentary, lateral view of a fourth embodiment of boat ladders in accordance with the invention.

The fourth embodiment of the new boat ladders shown in FIG. 14 is similar to the first embodiment of FIG. 1 except that the tubular members 14*c* are longer in the fore and aft direction than members 14 of FIG. 1 so that an additional plank 10*c* can be included in the platform section 4*c* thereby providing a larger working area for the platform. Also, additional brackets 8*a* are included to which the tubular members 14*c* may be fixed by pins 94 to firmly lock the platform section 4*c* against any movement. In this embodiment, therefore, the ladder section 6 may be folded into a retracted position (see FIG. 3), but the ladder 2*c* can not be moved into the folded position shown in FIG. 4.

Figure 15:
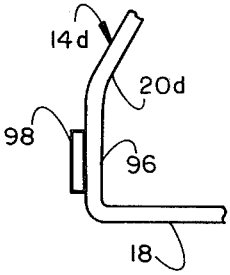
FIG. 15 is a fragmentary, lateral view showing a modification in the shape of frame members used in the new boat ladders.

A modification of the shape of the frame members 14 is shown in FIG. 15. The frame member 14*d* comprises an inboard side section 20*d* that includes at the junction with the bottom section 18 a straight portion 96. This form of frame member may be used to spread the bearing pressure applied by the lower inside end of the frame member to the transom of the boat, i.e., provide a line contact rather that an essentially point contact. This can be useful where the boat transom is relative thin as is the case with some types of inboard, high-speed boats. As an alternative to this, shaped blocks 98 or equivalent items, e.g., shims, may be attached either to the frame mambers 14 or the boat transoms 34 for this purpose or to accomodate special shaped or angled transoms to the new ladders.

While the various ladder sections 6 etc. have been shown and described as having only one step 68, such sections may include two or more steps (not shown) if desired, e.g., to raise the platform sections 4 etc. higher above the level of the water surrounding the boat.

Teak is a preferred wood for the planking 12 and steps 68, but marine plywood, oak or the like can be used. Also, stainless steel is the preferred metal for the planking 12*b* and steps 68*b*, but other metals resistant to corrosion by salt water may be used, e.g., aluminum, cortez steel, etc.

As will be apparent from the foregoing description, the support surfaces of the platform sections of the new boat ladders have no obstructions thereabove. Hence, a scuba diver or other person using the new ladders is not hampered by angular supports, upstanding brackets or the like above the support level. Hence, the user is free to move his body and gear freely about the support surface and to board and debark the ladder without snagging a wet suit, gear or the like. Also, since the ladder sections of the new ladders when in the extended position are held relatively immobile, the ladder user may move into and out of the water with complete safety and confidence that the ladder step or steps are not going to swing or otherwise move under his body or gear weight.

The embodiments of the invention in which an exclusive property or privilege is claimed are defined as follows:

1. A ladder for the transom of a boat which comprises:

a pair of brackets adapted to be fastened to the transom of a boat, a first quadrangular tubular member defined by a top section, a bottom section, a first side section and a second side section, said side sections being shorter than said top and bottom sections, said tubular member being hinged to one of said brackets at about the corner where said top section joins said first side section, a second quadrangular tubular member similar to said first spaced apart from said first member and similarly hinged to the second of said brackets, planking fixed to said top sections of said tubular members spanning the space between them, a third tubular member defined by a central section and two parallel end sections integral with said central section disposed in planes substantially perpendicular to said central section, said end sections being substantially identical and comprising a first short leg joined at one end to said central section, a long leg joined at one end to the other end of said first short leg and a second short leg joined at one end to the other end of said long leg, said legs of each end section lying in one plane with said long leg being approximately perpendicular to said first short leg and said second short leg extending from said long leg at an acute angle toward said first short leg, said end sections being spaced apart approximately the distance between the outboard sides of said first and second tubular members and being hinged to said second side sections of the tubular members adjacent the corner where said second side section joins said bottom section thereof, and planking fixed to said second short legs of said end sections spanning the distance between them.

2. The ladder of claim 1 wherein said second side section of each said tubular member is substantially perpendicular to its respective top and bottom sections, said bottom sections are longer than said top sections and said first side sections extend at an acute angle from said bottom sections.

3. The ladder of claim 1 wherein said planking is strips of wood.

4. The ladder of claim 1 wherein said planking is sheets of metal.

5. The ladder of claim 1 wherein said tubular members are formed from a length of tubing bent into said quadrangular shape so the ends of said tubing come together at said corner that is hinged to said brackets, said ends are partially flattened and are overlapped to create the corner by which the tubular members are hinged to said brackets.

6. The ladder of claim 5 wherein said brackets comprise a base with a pair of spaced apart lugs extending from one side thereof and said partially flattened, overlapped tubing ends are positioned between said lugs with a hinge pin extending through said lugs and said tubing ends.

7. The ladder of claim 1 that includes quadrangular tubular members in addition to said first and second tubular members, said additional members are hinged to brackets in manner similar to said first and second members, said additional members are spaced apart from each other and from said first and second members and planking extends across all said tubular members to form a platform extending substantially across the transom of the boat upon which said ladder is attached.

8. A ladder for the transom of a boat which comprises:

a platform section including horizontal planking and depending tubular frame members for pivoted attachment via said frame members to the transom of a boat to move between a raised position and a lowered position where said planking, when in the lowered position, is below the top of said transom, a ladder section having at least one step pivoted for movement between a retracted position wherein the step is raised above said planking inboard of the rear end of said platform section and an extended position wherein said step is lowered below said planking and held outboard of the rear end of said platform section, the pivoting of said ladder section being upon said tubular frame members below the plane of said planking whereby said platform section is free of elements projecting above said planking when said ladder section is in said extended position.

9. The ladder of claim 8 wherein said ladder section comprises a transverse member that abuts said tubular frame members when said ladder section is in said extended position to limit the extent said ladder section lowers below said planking.

10. The ladder of claim 9 wherein said tubular frame members are quadrangular is shape comprising a top section, a bottom section, an inboard side section and a outboard side section and said ladder section is pivoted on the outboard side sections of said quadrangular tubular members adjacent the corner junction of said outboard side section with said bottom section.

* * * * *